United States Patent [19]

Snyder

[11] 4,180,000

[45] Dec. 25, 1979

[54] FREIGHT CAR DOOR POST

[75] Inventor: Richard C. Snyder, Michigan City, Ind.

[73] Assignee: Pullman Incorporated, Chicago, Ill.

[21] Appl. No.: 804,213

[22] Filed: Jun. 7, 1977

Related U.S. Application Data

[63] Continuation of Ser. No. 606,822, Aug. 22, 1975, abandoned.

[51] Int. Cl.[2] ..... B61D 19/00

[52] U.S. Cl. ..... 105/409; 105/378; 105/423

[58] Field of Search ..... 105/355, 378, 467, 466, 105/475, 481, 483, 486, 396, 409, 423, 411; 296/28 R; 52/211, 376, 483, 730, 731

[56] References Cited

U.S. PATENT DOCUMENTS

| | | | |
|---|---|---|---|
| 1,682,281 | 8/1928 | Joiner | 52/211 |
| 1,688,016 | 10/1928 | Klaasen | 52/376 |
| 1,853,680 | 4/1932 | Hartbauer | 52/376 |
| 2,134,674 | 10/1938 | Sherman et al. | 52/376 |
| 2,167,835 | 8/1939 | Greulich | 52/376 |
| 2,429,182 | 10/1947 | Doke | 105/355 X |
| 2,884,874 | 5/1959 | Molt | 105/423 X |
| 2,900,926 | 8/1959 | Neuhart | 52/376 X |
| 3,089,436 | 5/1963 | Buckley | 105/423 X |
| 3,788,239 | 1/1974 | Bailey | 105/378 |
| 3,824,931 | 7/1974 | Hutchinson | 105/423 X |

*Primary Examiner*—Albert J. Makay
*Assistant Examiner*—Carl Rowold
*Attorney, Agent, or Firm*—Richard J. Myers

[57] ABSTRACT

A door post for a grain door of a freight car. The post comprises hollow two-piece metal sections forming the door edge. The sections are contoured to hold a nailing strip made either of wood or metal slotted construction. The nailing strip serves as a backing for the post and custions blows against the metal sections of the post longitudinally of the car by cargo being passed through the doorway.

8 Claims, 5 Drawing Figures

FREIGHT CAR DOOR POST

This is a continuation of Ser. No. 606,822, filed Aug. 22, 1975, now abandoned.

DISCUSSION OF THE PRIOR ART

The prior art is replete with combinations of metal and wood freight car wall, floor sections and posts such as in U.S. Pat. Nos. 2,900,926; 1,600,946; 2,167,835; 1,682,281; 1,853,680 and 1,688,016. These various combinations, however, do not embody the concept of having a hollow metal section which butts against a cushioning nailer section.

SUMMARY OF THE INVENTION

This invention is directed to a doorway structure and more specifically to novel door posts at the opposite lateral edges of the doorway which incorporate a nailer strip and forms a composite post assembly which is durable and effective in its function.

A more specific object to provide a novel door post having a metal portion which comprises an inner member and an outer member, these two members formed and arranged to form a vertical pocket therebetween which houses a flexible nailer strip which abuts a hollow portion defined by the configuration of the two metal members. This composite structure of the post assembly yieldably resists bumps thereagainst by the cargo or loading and unloading equipment being passed through the doorway.

These and other objects and advantages inherent in and encompassed by the invention will become more apparent from the specification and the drawings, wherein.

DESCRIPTION OF FIGS. 1-3

Figure 1:
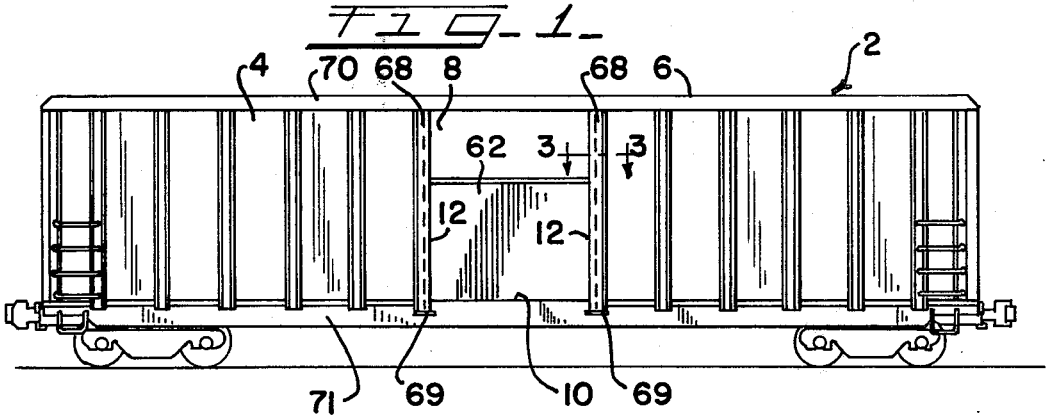
FIG. 1 is a side elevational view of a railway freight car incorporating the invention.
Figure 2:
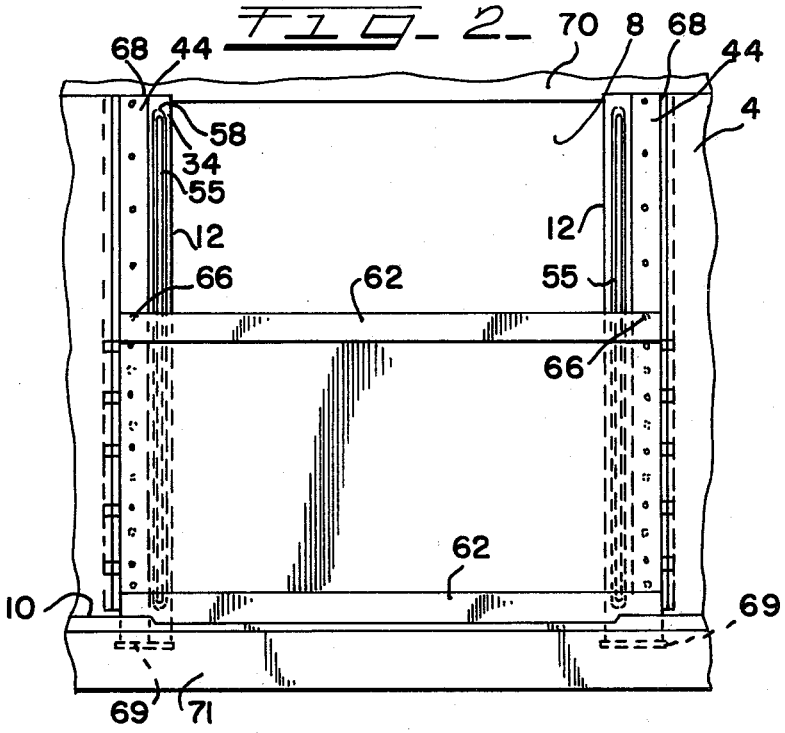
FIG. 2 is an enlarged side elevational view of the interior of the doorway portion of the freight car.
Figure 3:
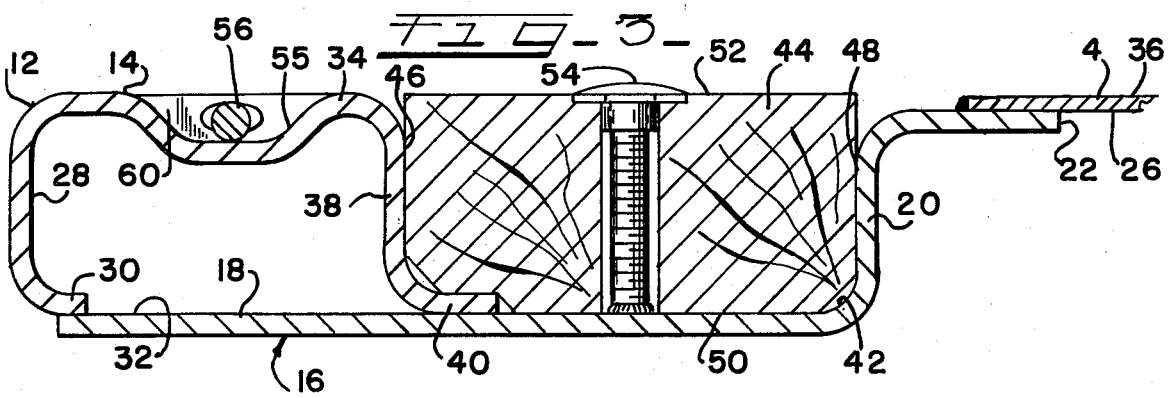
FIG. 3 is an enlarged transverse horizontal sectional view through the door post taken substantially on line 3—3 of FIG. 1.

The invention is illustrated with a freight car generally designated 2, which is provided with a side wall 4, a roof 6, a doorway 8 and a floor 10.

The doorway is flanked by a pair of door post assemblies 12, 12 each of which comprises a pair of vertical inner and outer metal members 14 and 16. The outer member is generally S-shaped in cross-section and comprises a longitudinal outer wall 18, a transverse wall 20 and an inner longitudinal wall 22 which is attached by welding to the external side 26 of the freight vehicle side wall 4. The inner metal member 14 of the post is generally U-shaped in cross-section and has a first transverse wall 28 which forms the doorway edge. Wall 28 has an outer flange 30 turned away from the doorway slidably seated against the inner side 32 of the outer longitudinal wall 18 of the outer member. The first transverse wall 28 is connected to a longitudinal wall 34 which is substantially coplanar with the interior surface 36 of the side wall 4. Wall 34 joins a second transverse wall 38 which extends to the interior side 32 of the longitudinal wall 18 of the outer metal member and the edge of the wall 38 adjacent to the outer member has an out-turned flange 40 seated against surface 32.

The second transverse wall 38 and transverse wall 20 define a vertically elongated pocket 42 therebetween into which is fitted a wooden nailing post 44 which fits tightly between the walls 38 and 20 at its sides 46 and 48 and on its back side 50 seats against the inner side 32 of the longitudinal wall 18 of the outer member. The inner side 52 of the wooden strip 44 is essentially coplanar with the inner surface 36 of the side wall 4. Strip 44 is secured by welding studs 54 to the outer wall 18.

The wall 34 is offset intermediate its ends and provides a vertically elongated well 55 in which a lading anchor rod 56 is positioned. The rod 56 is attached at its upper and lower ends to upper and lower webs 58 and 60 of the well or depression 55. Grain boards 62 are disposed across the doorway and are nailed at opposite ends by nails 66 to the wooden post strips.

The posts are connected at their upper and lower ends 68 and 69 to the upper and lower floor and roof sills 70 and 71.

Figure 4:
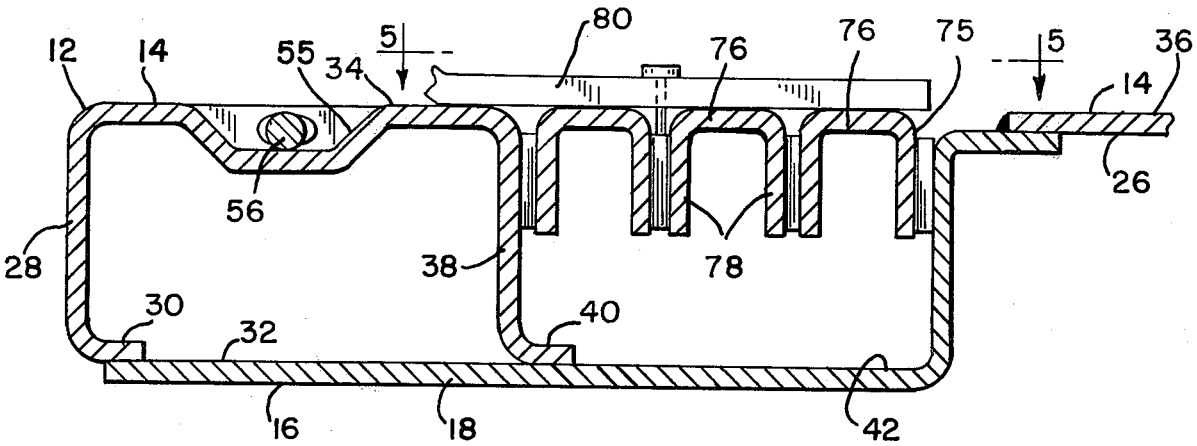
FIG. 4 is a sectional view substantially similar to FIG. 3 of another embodiment of the invention.
Figure 5:
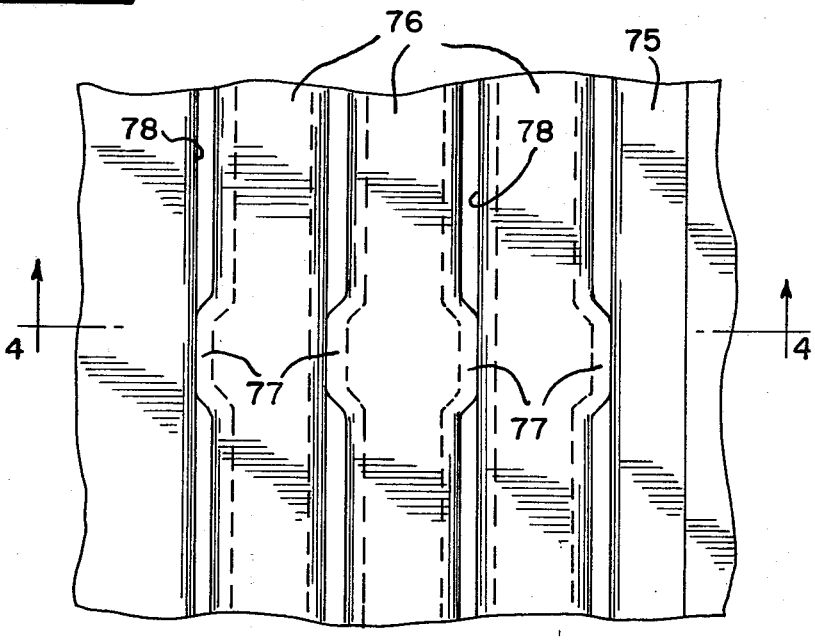
FIG. 5 is a side elevational view of a portion of FIG. 4 taken substantially on line 5—5 of FIG. 4.

EMBODIMENT OF FIGS. 4 and 5

This embodiment is identical with the previous embodiment and like parts are identified by corresponding reference numbers. The only difference is in the nailing post 75 is formed of a plurality of U-section metal strips 76, which are vertically elongated and laid side by side. At periodic intervals the side flanges 78, 78 of the strips 76 are bent out to provide spacers 77 which maintain the strips 76 in spaced relation to provide nail grooves 78, 78 therebetween so that the nails can be driven between the strips 76 and hold an anchor strap 80 thereon. The metal strips 76 are laterally flexible, and restrain a driven nail.

Having described several embodiments of the invention, it will become apparent that an effective post assembly has been provided. Various embodiments of the invention will suggest themselves to those skilled in the art and as covered by the appended claims.

What is claimed is:

1. A door post assembly for a freight vehicle having upper and lower sills comprising a hollow metal portion defining a doorway edge and a resilient nailable section disposed in laterally abutting relation to the metal portion, said metal portion comprising inner and outer vertical members, said inner member being U-shaped in cross-section and having transverse webs including means slidably seated against a longitudinal wall of the outer member and means securing the upper and lower ends thereof to the upper and lower sills of the vehicle, respectively, and said metal portion being laterally deflectable against said resilient nailable section for yieldably resisting lateral blows directed against said metal section.

2. The invention according to claim 1, and said nailable section comprising a wooden post.

3. The invention according to claim 1, and said resilient nailable section comprising a stack of laterally resilient metal strips spaced apart at intervals and defining a plurality of parallel nailing slots therebetween.

4. The invention according to claim 1, and said metal portion having portions remote from the doorway complementally receiving said nailable section therebetween.

5. The invention according to claim 1, and said nailable section comprising a block of wood and said inner and outer members having transverse walls tightly embracing the wood block therebetween.

6. The invention according to claim 5, and said transverse webs being aligned laterally with the wood block.

7. The invention according to claim 1, and said outer member being S-shaped and having a transverse wall bearing against a side of the nailable section remote from said inner member.

8. The invention according to claim 7, and said inner member having a rigid lonigudinal wall including a dished lading strap anchor.

* * * * *